United States Patent [19]

Scaffidi

[11] 4,403,598

[45] Sep. 13, 1983

[54] HEATING ELEMENT FOR AN OPEN FIREPLACE

[76] Inventor: Cono T. Scaffidi, 3401 E. Pratt St., Baltimore, Md. 21224

[21] Appl. No.: 209,879

[22] Filed: Nov. 24, 1980

[51] Int. Cl.[3] ..... F24B 7/00

[52] U.S. Cl. ..... 126/121; 126/131

[58] Field of Search ..... 126/121, 131, 132, 164, 126/152 B, 143, 129, 130

[56] References Cited

U.S. PATENT DOCUMENTS

| | | | |
|---|---|---|---|
| 1,740,996 | 12/1929 | Muir | 126/121 |
| 1,783,140 | 11/1930 | Quinliven | 126/121 |
| 3,394,697 | 7/1968 | Lewis | 126/132 |
| 3,995,611 | 12/1976 | Nelson | 126/131 X |
| 4,151,827 | 5/1979 | Rae | 126/131 X |
| 4,175,539 | 11/1979 | McGuire | 126/121 |
| 4,187,830 | 2/1980 | Creasey | 126/131 X |

FOREIGN PATENT DOCUMENTS

| | | | |
|---|---|---|---|
| 2261386 | 9/1975 | France | 126/121 |

*Primary Examiner*—Larry Jones

*Attorney, Agent, or Firm*—Walter G. Finch

[57] ABSTRACT

The invention relates to means for recovering a portion of the heat from an open fireplace and conducting it to other parts of a room, a house, or a building or other enclosure. The device is of particular importance for energy conservation. The device is a heating element that becomes part of an open fireplace in a disguised form. The heating element consists of disguised panels on the bottom and sides of an open fireplace, with the panels communicating with each other at their interfaces and the side panels connected at the top edge by a pipe system, hidden from view. Inlet and outlet connection means are made at the side panels.

10 Claims, 2 Drawing Figures

HEATING ELEMENT FOR AN OPEN FIREPLACE

BACKGROUND AND SUMMARY OF THE INVENTION

The invention relates to heating elements and in particular to heating elements for open fireplaces. Specifically, the invention relates to a means for recovering part of the heat from an open fireplace for purposes of energy conservation and conducting it to other parts of a room, a house, or a building.

The conservation of energy is of tremendous importance to the nation. This invention is an aid in that cause. By recovering part of the heat from an open fireplace, that otherwise would be lost up the chimney, and conducting it to other parts of a room, a house, or a building, use of other energy means in the main heating system is conserved.

The present invention can be tied or connected into the present heating system. When so connected, the recovered heat can serve as a preheater for the main heat conducting element of the primary heating system. It can also serve as the necessary heating means for the main heat conducting element of the primary heating system during times of heating demand that do not require supplemental heat from the primary heating system. In very severe heating requirements it can serve as a supplemental heating means for the primary heating system. In all of these aforementioned conditions the present invention conserves energy by reducing or eliminating the need for using the energy means for the primary heating system.

It is to be understood that where the heat supply of the present invention is sufficient for the heating needs, it is not necessary to connect it to a primary heating system. The present invention may be operated on its own without connection to a primary heating system. In the present invention the panels, or jackets, which carry the heat conducting medium, are disguised so that they appear to be the fireplace floor and walls and do not detract from the normal appearance of the fireplace.

An inlet on one side at the side panel provides the means for having the heat conducting medium enter the invention, and an outlet on the opposite side at the opposite side panel provides the means for the flow of the heat conducting medium into the heat dispensing means (for the room, house, or building).

A connecting means at the top of the side panels permits them to communicate at the top level so as not to trap the heated heat conducting medium. The connecting means is hidden from view when looking into the open fireplace. The bottom panel communicates with the side panels where they interface so that the heat conducting medium in the system may pass through all parts of the invention. The heat conducting medium may be water or any other suitable medium. Water is a usual medium.

The inlet on one side, as noted hereinbefore, is normally at the bottom of a first side panel or jacket. The outlet on the opposite side, as noted hereinbefore, is normally at the top of a second side panel or jacket.

It is, therefore, an object of the invention to provide a means for recovering a portion of the heat from an open fireplace.

It is another object of the invention to provide a heat recovery means to conduct recovered heat from an open fireplace to other areas for heating purposes.

It is also an object of the invention to provide a disguised means for recovering heat from an open fireplace so that the means for recovering heat is not readily observable when looking into the fireplace.

It is still another object of the invention to provide a heat recovery means to recover heat from an open fireplace in order to conserve energy.

It is yet another object of the invention to provide a heat recovery means that may be operated independently of any other heating system.

It is yet still another object of the invention to provide a heat recovery means that may be connected to another heating system to work in conjunction with it.

Further objects and advantages of the invention will become more apparent in the light of the following description of the preferred embodiments.

DESCRIPTION OF THE PREFERRED EMBODIMENTS

Figure 1:
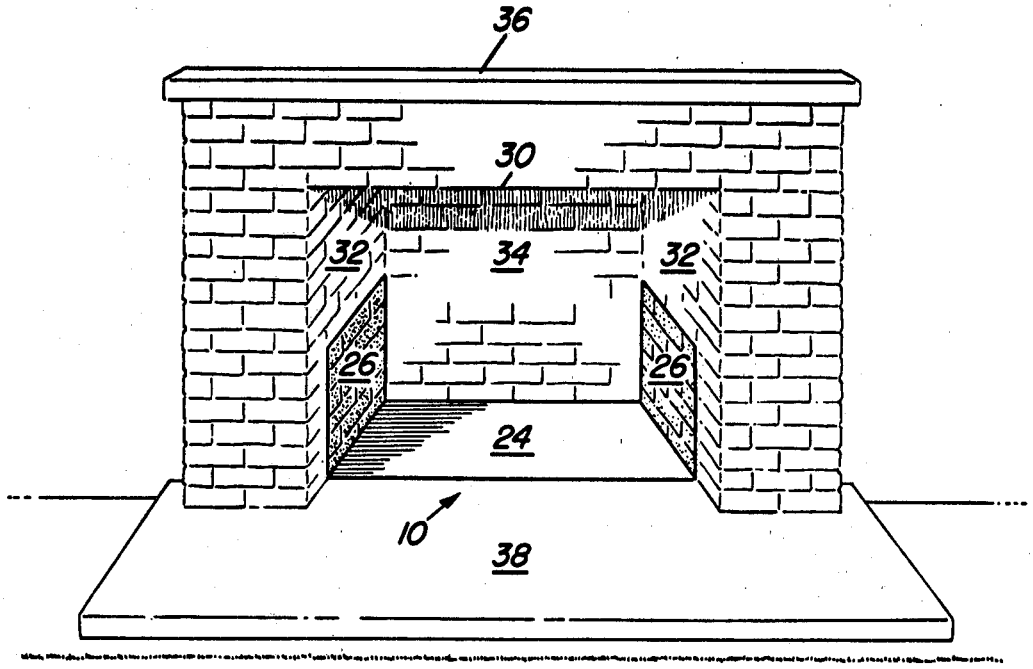
FIG. 1 is a pictorial perspective view of an open fireplace showing the general incorporation of a heating element.
Figure 2:
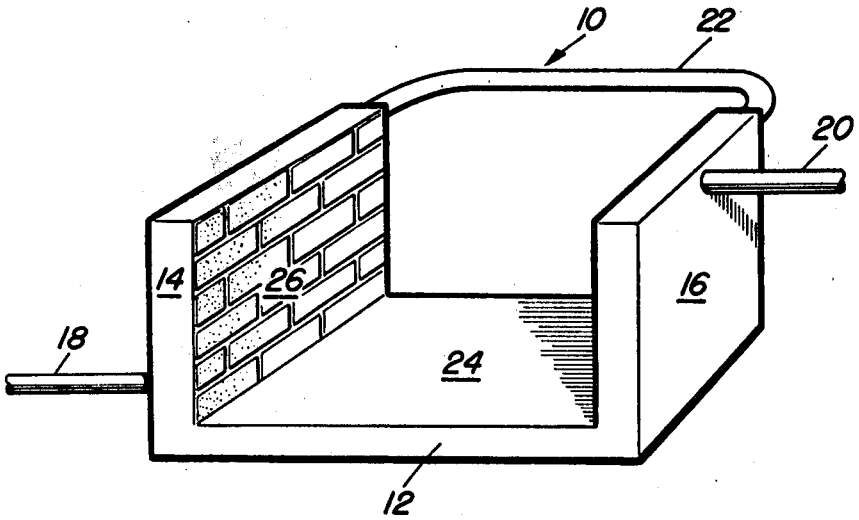
FIG. 2 is a pictorial perspective representation of the heating element for an open fireplace as in FIG. 1.

Referring to the drawings, an improved heating element for an open fireplace for the recovery of heat is shown at 10 in FIGS. 1 and 2.

The heating element consists of a bottom or floor panel or jacket 12, a first side panel or jacket 14, a second side panel or jacket 16, an inlet means 18, an outlet means 20, and a top connecting or communicating means 22. The first and second side panels or jackets 14 and 16 extend upward from said bottom or floor panel or jacket 12 at 90° for a portion of the interior height of open fireplace 30.

The first and second side panels or jackets 14 and 16, and the bottom or floor panel or jacket 12 are tank-like and the interior thereof communicate with each other at the interface of panels 14 and 16 with panel 12.

The inlet means 18, which may be pipe-like or tube-like of any configuration is normally connected at the bottom of one of the side panels 14 or 16 (shown in FIG. 2 connected to panel 14). The interior of inlet means 18 communicates with the interior of side panel 14 (or 16, however connected). It is to be understood that the inlet means 18 may be connected at any point on side panel 14 (or 16), but a bottom connection is preferable so that the colder heat transfer medium enters at the lowest point.

The outlet means 20, which may be pipe-like or tube-like of any configuration is normally connected at the top of the opposite side panel 16 or 14 (shown connected to panel 16). The interior of outlet means 20 communicates with the interior of of side panel 16 (or 14 however connected). It is to be understood that the outlet means 20 may be connected at any point on side panel 16 (or 14), but a top connection is preferable so that the heated heat transfer medium, which rises, leaves the device 10 at the uppermost point.

In order not to trap the heated heat transfer medium in the upper portion of the side panel 14 (or 16) on the inlet side (panel 14 as shown in FIG. 2), a connecting or communicating means 22 connects together the tops of side panels 14 and 16. The interior of connecting or communicating means 22 communicates with the interiors of side panels 14 and 16, thus permitting heated heat transfer medium of side panel 14 (on the inlet side) to flow to the side panel 16 (on the outlet side).

The inlet means 18 and the outlet means 20 are connected into a heat dispensing means system known in the art or into a primary heating system known in the art. The connections are made in the direction of flow of the heat dispensing system.

Side panels 14 and 16 and bottom panel 12 are made of any suitable metal which will withstand the direct heat of a fire built in the open fireplace 30. The inlet means 18, the outlet means 20 and the communicating means 22 may be connected to the side panels 14 and 16 by any means known in the art (welded, brazed, threaded, or other means).

It is to be noted that side panels 14 and 16 may be set at a right angle relation to the forward edge of bottom panel 12 or may be set at less than a right angle relation to the forward edge of bottom panel 12. A right angle relation is depicted in FIG. 2. The perspective view in FIG. 1 appears as less than a right angle, though as a perspective could be a right angle, When the heating element 10 is installed in an open fire place 30 (in a new fireplace being built or in an existing fireplace being renovated) the heating element is installed so as to be substantially unnoticeable. The topmost surface 24 of the bottom or floor panel or jacket 12 is set flush with the existing or what would be the existing floor of the open fireplace 30. The innermost surface 26 of the side panels or jackets 14 and 16 is scored in brick-like fashion so that it blends into the existing brickwork 32 above the side panels or jackets 14 and 16 and the brickwork 34 at the back of the fireplace 30. The innermost surfaces 26 of the side panels or jackets 14 and 16 are set flush with the surrounding brick work 32 of the fireplace 30.

The brick-like scored innermost surface 26 of side panels or jackets 14 and 16 may be coated with a thin ceramic-like coating that is fire resistant, but not heat insulating, to make it less noticeable in blending arrangement with the brickwork. Fire and smoke discoloration will further enhance the blending aspects.

Note that the side panels 14 and 16 when set flush with the brickwork 32 in the fireplace 30 is also set back slightly from the front surface of the fireplace 30 in order to maintain the natural look.

The communicating means 22 is hidden from view as it is in back of or within the back wall 34 of the open fireplace 30. This is accomplished by the manner in which the transverse portion of the communicating means 22 extends away from the side panels 14 and 16 in a rearward direction.

Thus, when looking at and into the open fireplace 30, one sees the mantel 36, the hearth 38, the floor or rug 40 of the room, and what appears to be the normal bricked interior of the open fireplace 30; the scored brick-like innermost surfaces 26 of panels or jackets 14 and 16 disguise the heat element 10 when installed. Thus, heat conservation and energy savings is accomplished without destroying the asthetic value of the open fireplace 30.

As can be readily understood from the foregoing description of the invention, the present structure can be configured in different modes to provide the ability to recover heat from an open fireplace.

Accordingly, modifications and variations to which the invention is susceptible may be practiced without departing from the scope and intent of the appended claims.

What is claimed is:

1. A substantially indistinguishable heating element for an open fireplace, comprising:

a first jacket means, the interior of said first jacket means being hollow, said first jacket means serving as a bottom;

a second jacket means, the interior of said second jacket means being hollow, said second jacket means being affixed to said first jacket means, said hollow interiors of said first and second jacket means communicating with each other, said second jacket means serving as a first side;

a third jacket means, the interior of said third jacket means being hollow, said third jacket means being affixed to said first jacket means, said hollow interiors of said first and third jacket means communicating with each other, said third jacket means serving as a second side;

an inlet means, said inlet means being pipe-like, said inlet means being affixed to said second jacket means, said pipe-like inlet means communicating with said interior of said second jacket means;

an outlet means, said outlet means being pipe-like, said outlet means being affixed to said third jacket means, said pipe-like outlet means communicating with said interior of said third jacket means;

a communicating means, said communicating means being pipe-like, said communicating means being affixed to and between said second and third jacket means, said pipe-like communicating means communicating with said interiors of said second and third jacket means, said first, second, and third jacket means, said inlet and outlet means, and said communicating means forming a heating element for installation in an open fireplace, said communicating means being obscured from view when installed in said open fireplace;

brick-like scoring, said brick-like scoring being applied to the innermost of outer surfaces of said second and third jacket means, said brick-like scoring conveying a brick-like appearance; and a ceramic-like coating, said ceramic-like coating being heat resistant and non-insulating, said ceramic-like coating being applied to said innermost of outer surfaces of said second and third jacket means over said brick-like scoring.

2. A heating element as recited in claim 1, wherein said hollow first, second, and third jacket means are each a rectangular prism in configuration and tank like, said second and third jacket means, serving as said first and second sides respectively, extending upward at more or less right angles from said first jacket means from interface where affixed thereto, said first, second, and third jacket means being fully enclosed except where interfacing and communicating with each other.

3. A heating element as recited in claim 2, wherein said second and third jacket means are aligned at a right angle to the forward edge of said first jacket means.

4. A heating element as recited in claim 2, wherein said second and third jacket means are aligned at less than a right angle to the forward edge of said first jacket means.

5. A heating element as recited in claim 1, wherein the interior of said inlet means communicates with the interior of said second jacket means.

6. A heating element as recited in claim 1, wherein the interior of said outlet means communicates with the interior of said third jacket means.

7. A heating element as recited in claim 1, wherein one end of said communicating means being connected at the uppermost portion of said second jacket means and the other end being connected at the uppermost portion of said third jacket means, the communicating means between said second and third jackets being extended away from said second and third jackets.

8. A heating element as recited in claim 1, wherein said inlet means is connected to said second jacket means at the lowermost portion of said second jacket means.

9. A heating element as recited in claim 1, wherein said outlet means is connected to said third jacket means at the uppermost portion of said third jacket means.

10. A heating element as recited in claim 1, wherein said heating element is installed in said open fireplace so that uppermost outer surface of said first jacket is substantially located at projected level of the floor of said open fireplace, and so that the innermost outer surface of said second and third jackets are flush with the projected side walls of said open fireplace, and said communicating means is hidden from direct view by the rear wall of said open fireplace which is located in front of said communicating means.

* * * * *